US005212877A

United States Patent [19]

Onur et al.

[11] Patent Number: 5,212,877

[45] Date of Patent: May 25, 1993

[54] METHOD OF AND APPARATUS FOR DRYING COATED SUBSTRATES

[75] Inventors: Emin Onur; Georg Johnke, both of Hamburg, Fed. Rep. of Germany

[73] Assignee: Pagendarm GmbH, Hamburg, Fed. Rep. of Germany

[21] Appl. No.: 721,184

[22] Filed: Jun. 26, 1991

[30] Foreign Application Priority Data

Jul. 24, 1990 [DE] Fed. Rep. of Germany ..... 4023442

[51] Int. Cl.[5] ..... F26B 3/00

[52] U.S. Cl. ..... 34/29; 34/40; 34/72; 34/54; 34/36; 118/61

[58] Field of Search ..... 34/209-210, 34/36, 37, 40, 41, 74, 75, 77, 28, 29, 32, 33, 34, 54; 118/61, 13, 58

[56] References Cited

U.S. PATENT DOCUMENTS

| | | | |
|---|---|---|---|
| 4,118,873 | 10/1978 | Rothchild | 34/36 |
| 4,150,494 | 4/1979 | Rothchild | 34/36 |
| 4,185,397 | 1/1980 | Hutzenlaub | 34/36 |
| 4,223,450 | 9/1980 | Rothchild | 34/36 |
| 4,365,954 | 12/1982 | Petzi | 34/36 |
| 4,370,357 | 1/1983 | Swartz | 34/36 |
| 4,543,060 | 9/1985 | Bowes | 34/36 |
| 4,886,564 | 12/1989 | Pagendarm | 156/230 |
| 4,894,927 | 1/1990 | Ogawa et al. | 34/36 |

*Primary Examiner*—Henry A. Bennet
*Assistant Examiner*—Denise Gromada
*Attorney, Agent, or Firm*—Peter K. Kontler

[57] ABSTRACT

A running substrate which is coated with a solvent-containing material is conveyed through several sections of a drying unit and is dried with a stream of inert gas which is conveyed counter to the direction of movement of the substrate. The temperature of inert gas is reduced during flow from section to section and the quantity of solvent in the inert gas is maintained slightly below saturation value during the initial stage of the drying operation to thus enhance the surface finish of the coating. The stream of inert gas is circulated along an endless path a portion of which coincides with the path for the substrate, and the inert gas is heated to maximum drying temperature before it enters the downstream end of the path for the substrate.

14 Claims, 1 Drawing Sheet

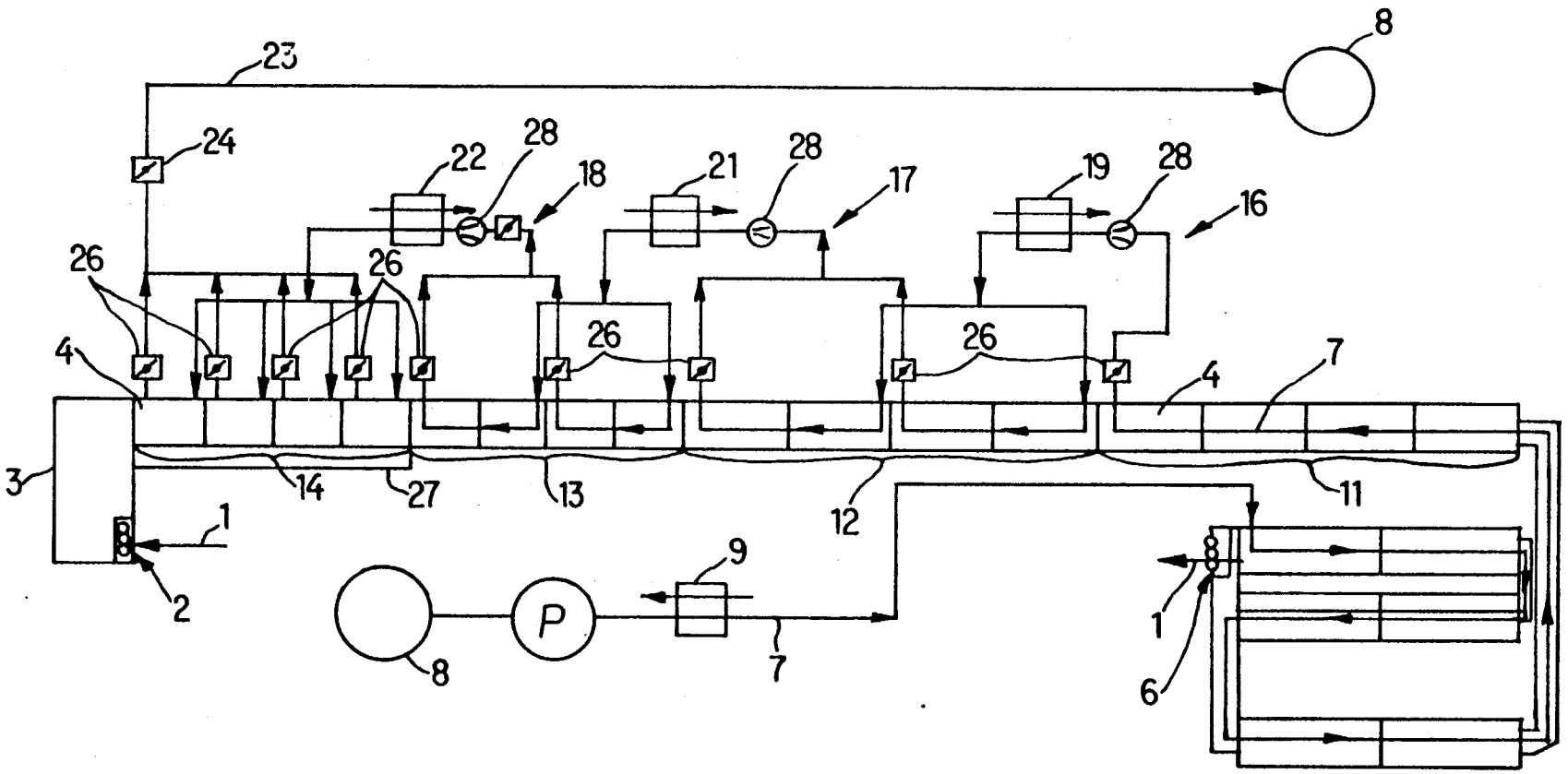
8
16
28
19
17
28
21
18
28
22
23
24
7
4
26
26
26
26
11
12
13
14
27
1
6
7
9
P
8
1
2
3
4

METHOD OF AND APPARATUS FOR DRYING COATED SUBSTRATES

BACKGROUND OF THE INVENTION

The invention relates to improvements in methods of and in apparatus for drying elongated substrates in the form of webs or strips which are made of paper, textile material or the like. More particularly, the invention relates to improvements in methods of and in apparatus for expelling volatile constituents (particularly solvents) from coatings of elongated substrates.

It is already known to expel solvents and/or other volatile constituents (hereinafter called solvents) from the coatings of running substrates by contacting the substrates with an inert gas, for example, nitrogen. Such treatment (drying) of coated substrates is desirable and advantageous if it involves expulsion of solvents from coatings of highly sensitive substrates or from highly sensitive coatings of substrates. Examples of such substrates are magnetic tapes and webs which are coated with adhesive substances. Convective drying has been found to be particularly effective in connection with the expulsion of solvents from such coatings. Proper selection of parameters (such as pressure, temperature and velocity) of inert gases which are used to expel volatile constituents from coated substrates in the form of magnetic tapes is particularly important because such parameters determine the surface roughness of the finished product. As a rule, the inert gas is nitrogen which should contain less than 1% oxygen in order to reduce the danger of explosion as a result of saturation of inert gas with solvents in the course of the drying operation. Presently preferred driers are so-called nozzle driers, and their exact design depends on the sensitivity of the substrate and/or the coating which is carried by the substrate. For example, if the substrate and its coating constitute a lightweight magnetic tape, the drier is preferably a suspension drier which is designed to maintain the running substrate in a suspended state, i.e., the running substrate is completely surrounded by a stream of inert gas which is discharged by suitably positioned and oriented nozzles. If the substrate and its coating constitute a relatively heavy web, the drier can be provided (a) with rollers or pulleys which contact the uncoated side of the substrate and (b) with nozzles which direct jets of inert gas against the coating at the other side of the substrate.

A presently known apparatus for expelling solvents from coatings on substrates is disclosed in commonly owned U.S. Pat. No. 4,886,564 granted Dec. 12, 1989 to Ralf Pagendarm et al. for "Method of and apparatus for applying coating material to a running substrate".

OBJECTS OF THE INVENTION

An object of the invention is to provide a novel and improved method of expelling volatile constituents from the coatings of running substrates which are made of paper, textile, plastic or other suitable material.

Another object of the invention is to provide a method which ensures complete or nearly complete recovery of inert gas.

A further object of the invention is to provide a method which can be utilized for expulsion of volatile constituents from sensitive coatings of less sensitive substrates, from sensitive coatings of sensitive substrates or from coatings of sensitive substrates.

An additional object of the invention is to provide a simple and economical method of drying coated substrates while the substrates are advanced at an elevated speed.

Still another object of the invention is to provide a novel and improved method of conditioning the inert gas prior to, during and after contact with the running substrate.

A further object of the invention is to provide a method which ensures highly predictable expulsion of volatile constituents from the coating of a running substrate in a suspension drier or an analogous drier.

An additional object of the invention is to provide a novel and improved apparatus for the practice of the above outlined method.

Another object of the invention is to provide an apparatus which is constructed and assembled in such a way that it can ensure optimal drying of webs or strips of magnetic tape, adhesive-coated tape and like products.

A further object of the invention is to provide the apparatus with novel and improved means for conveying and conditioning the inert gas prior to, during and after contact with the coating of a running substrate of paper, plastic foil, textile or metallic foil.

Another object of the invention is to provide the apparatus with novel and improved means for conveying the substrate and the inert gas relative to each other.

SUMMARY OF THE INVENTION

One feature of the present invention resides in the provision of a method of expelling volatile constituents or ingredients (particularly solvents) from an elongated substrate, such as a web of paper, textile material or the like, which has a coating containing volatile constituents (such as solvents) and which is to be dried as a result of expulsion of volatile constituents. The improved method comprises the steps of moving the substrate in a first direction along a predetermined path having an inlet at one end and an outlet at the other end, admitting a stream of inert gas into the predetermined path at the outlet and conveying the admitted stream along the predetermined path in a second direction counter to the first direction whereby the inert gas expels volatile constituents from and entrains the expelled volatile constituents toward the inlet of the predetermined path, heating the inert gas to a maximum drying temperature prior to admission into the predetermined path, withdrawing the inert gas and the entrained volatile constituents from the predetermined path at the inlet, and conditioning the inert gas during flow from the outlet toward the inlet of the predetermined path. The conditioning step includes maintaining the inert gas slightly below a condition of saturation with volatile constituents not later than at the inlet of the predetermined path. This can be achieved by cooling the stream of inert gas. The cooling step can include cooling the stream of inert gas in a plurality of successive stages, and each such stage can include conveying inert gas along a second path from and back into the predetermined path and cooling the inert gas in the second path. Each such stage preferably further includes maintaining the temperature of inert gas at a substantially constant value in a section of the predetermined path.

The method preferably further comprises the step of measuring the concentration of entrained volatile constituents in the stream which is withdrawn from the predetermined path. The conditioning step then includes regulating the mass flow of inert gas in the predetermined path as a function of measured concentration of volatile constituents to thus ensure that the inert gas is maintained slightly below the aforementioned condition of saturation not later than at the inlet of the predetermined path.

The method can further comprise the step of regulating the speed of flow of inert gas along the predetermined path. Such regulating step can include reducing the speed of the stream of inert gas during flow from the outlet toward the inlet, either gradually or stepwise.

The conveying step can include advancing the stream of inert gas along an endless path having a portion which coincides with the predetermined path for the substrate and its coating.

Another feature of the present invention resides in the provision of an apparatus for expelling volatile constituents from the coating of an elongated substrate, such as an elongated web of paper or textile material at least one side of which carries one or more layers which are to be treated to effect expulsion of solvents and/or other volatile constituents. The apparatus comprises means for moving the substrate in a first direction along a predetermined path having an inlet and an outlet (i.e., along a path of finite length), a source of inert gas (e.g., nitrogen), means for conveying a stream of inert gas from the source along a second path having a portion which coincides with the predetermined path and wherein the inert gas flows in a second direction counter to the first direction, and means for heating the stream of inert gas.

The apparatus can further comprise means for cooling the inert gas in the aforementioned portion of the second path. Such portion of the second path can include a plurality of sections wherein the stream of inert gas flows from and back into the predetermined path, and the cooling means preferably includes devices (e.g., heat exchangers) for cooling the stream of inert gas in such sections of the second path.

The apparatus can further comprise means for regulating the rate of flow of inert gas in at least one section of the second path.

The apparatus can further comprise means for returning the stream of inert gas from the inlet of the predetermined path to the source, and means for regulating the rate of flow of inert gas in such returning means.

The conveying means can define an endless second path for the stream of inert gas.

The predetermined path preferably comprises a plurality of sections including a first section at the inlet and a last section at the outlet. Such apparatus can further comprise means for heating the first section to a temperature slightly above the temperature of inert gas in the first section.

The conveying means can include a conduit which connects the source with the outlet, and the means for heating the stream of inert gas can include a heat exchanger or another heating device which is operative to heat inert gas in such conduit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a diagrammatic view of an apparatus which embodies one form of the invention and wherein the stream of inert gas is caused to circulate along an endless path, the source of inert gas being shown twice.

DESCRIPTION OF PREFERRED EMBODIMENTS

The drawing shows an apparatus for drying coated substrates in the form of webs 1. A web 1 which is to be dried is admitted into an elongated path which has an inlet at 2 and an outlet at 6. The inlet 2 is defined by a set of web advancing or moving rolls in a coating unit 3 wherein a layer or film of liquid coating material is applied to at least one side of the running web 1. The liquid coating material contains at least one volatile constituent, particularly solvent. The apparatus is designed to expel the volatile constituent or constituents (hereinafter called solvent) from the layer or film on the substrate 1 in order to stabilize and strengthen the layer.

The apparatus further comprises a plurality of successive drying chambers 4 each of which contains nozzles or other suitable means for directing jets of a preheated inert gas against both sides of the running web 1. The web is caused to float during advancement through the chambers 4 to thus enhance the drying action by controlled expulsion of solvent. The outlet 6 for successive increments of the web 1 contains several web moving or advancing rollers which prevent the escape of inert gas and/or solvent.

The inert gas which is used to expel solvent from the layer on the web 1 is conveyed by a pump P (installed in a conduit 7) along an endless path a portion of which coincides with the path for the web 1. The direction of flow of a stream of inert gas from a source 8 is indicated by arrows. The direction of flow of inert gas through the chambers 4 is counter to the direction of transport of the web 1. The source 8 can constitute a condensate separator, and the stream which issues from this source is caused to pass through a heat exchanger 9 on its way into the path for the web 1 at the outlet 6. The heat exchanger 9 is set to raise the temperature of inert gas to a maximum drying temperature, for example, 90° C. Thus, the temperature of inert gas which enters the last (11) of a total of four sections (11, 12, 13, 14) of the web drying unit is maintained at the maximum drying temperature. Each section of the heating unit can comprise one or more chambers 4. In the illustrated embodiment, the first section 14 comprises a row of four chambers 4, the same as each of the sections 13, 12 and 11. As mentioned above, each chamber 4 contains one or more nozzles above and one or more nozzles below the running web 1, and such nozzles discharge and direct inert gas against the respective sides of the web 1 so that the latter floats on its way through the chambers 4 of the first section 14, second section 13, third section 12, and last or fourth section 11. The nozzles which direct inert gas from above alternate with nozzles which direct gas from below (as seen in the direction of transport of the web 1 from the coating unit 3 toward the outlet 6.

The temperature of inert gas is maintained at a constant value in each of the sections 11 to 14. The layers on those increments of the web 1 which advance through the last section 11 (as well as the increments of the web) contain a relatively small percentage of residual moisture, and such residual moisture can be readily expelled by the relatively hot (90° C.) unsaturated inert gas which is admitted at 6 to flow first through the last section 11 on its way toward the sections, 12, 13, 14 and out of the chambers 4 of the first section 14. The partial pressure of inert gas flowing through the section 11 is high.

The stream of inert gas which has entered the last section 11 is cooled in a first stage prior to being admitted into the next-to-the-last section 12. Furthermore, the inert gas is cooled in a second stage on its way from the section 12 into the section 13, and in a third stage on its way from the section 13 into the section 14. In the illustrated apparatus, the means for cooling the inert gas are designed in such a way that the temperature of the stream is reduced to 70° C. for admission into the section 12, to 50° C. for admission into the section 13, and to 40° C. for admission into the section 14. Those sections of the (second) path for the stream of inert gas wherein the gas is cooled in three stages are defined by conduits 16, 17 and 18 which are connected in parallel and each of which conveys inert gas from the path for the web 1 and back into such path.

The conduit 16 contains a heat exchanger 19 which withdraws heat from the inert gas flowing from the last chamber 4 of the section 11 into two chambers 4 of the section 12. A heat exchanger 21 is installed in the conduit 17 to withdraw heat from inert gas flowing from two chambers 4 of the section 12 into two chambers 4 of the section 13. A further heat exchanger 22 is installed in the conduit 18 to withdraw heat from inert gas flowing from two chambers 4 of the section 13 into all four chambers 4 of the section 14.

The partial pressure $\Delta P$ of inert gas drops to zero or close to zero at the time the gas reaches the first section 14. This is due to progressively decreasing temperature of inert gas and to progressing saturation of inert gas with solvent. Inert gas which flows in the section 14 is maintained in a state slightly below the saturation limit. This is desirable and advantageous because the inert gas effects a relatively gentle expulsion of some solvent from the still unstable coating on the web 1 which advances in the section 14 toward and into the section 13. Thus, the treatment of the web 1 in the section 14 is such that the layer which was applied in the unit 3 is treated gently and, therefore, the surface of the layer which issues from the improved apparatus is smooth.

The reference character 23 denotes a conduit which serves to convey inert gas from the first section 14 back into the source 8 for renewed admission (via conduit 7) into the apparatus at the outlet 6 for the web 1. The conduit 23 contains a combined saturation monitor and mass flow regulator 24 which controls the stream of inert gas in such a way that the gas flowing in the first section 14 is maintained slightly below the saturation limit. Additional combined saturation monitors and mass flow regulators 26 are installed in the conduits 16, 17 and 18 to ensure that the extent of saturation of inert gas can be regulated with a requisite degree of accuracy, i.e., the saturation of inert gas with solvent in the conduit 16 is less than in the conduit 17, and saturation of inert gas with solvent in the conduit 17 is less than in the conduit 18.

The drawing shows that the dimensions of all chambers 4 need not be the same. This is often desirable in order to account for the dimensions of nozzles in the chambers 4 and to ensure predictable impingement of jets of inert gas upon the running web 1 which can be imparted a substantially sinusoidal shape on its way through all four sections 14, 13, 12, 11 of the drying unit.

The walls of chambers 4 in the first section 14 are heated at 27 in order to prevent condensation of solvent.

The velocity of the stream of inert gas in the section 11 is higher than in the section 12, higher in the section 12 than in the section 13, and higher in the section 13 than in the section 14. This is considered to be desirable and advantageous in many instances because one can account for varying sensitivity of the web 1 and the layer thereon during different stages of the drying operation. The velocity of the gas stream can be regulated by flow restrictors 28 which are preferably of the adjustable type.

An advantage of the feature that the inert gas is circulated along an endless path a portion of which (between 6 and 2) coincides with the path for the web 1 is that the operation is economical because the energy requirements of the apparatus are low.

The flow regulators 24 and 26 render it possible to rapidly adjust the apparatus for the drying of different types of substrates and/or for the drying of substrates carrying coatings of different materials and requiring different types of treatment during expulsion of solvent.

Another advantage of the improved method and apparatus is that the expulsion of solvent takes place gradually and by full consideration of sensitivity and/or other characteristics of the material of the substrate and of the material of the layer or layers which are applied in the coating unit 3. The low partial pressure of nearly saturated and cooled inert gas in the section 14 ensures that the rate of escape of solvent from the coating of the web 1 in the chambers 4 of the section 14 is relatively low with attendant improvement of the condition (smoothness) of the coating which advances into the section 13. The partial pressure of inert gas (as well as its temperature) is higher in the section 13 than in the section 14, and so forth, so that the inert gas is capable of reliably expelling residual solvent before the web 1 reaches the outlet 6. Expulsion of residual solvent with an inert gas which is maintained at a higher temperature and at a higher partial pressure takes place at a time (in the sections 13, 12 and 11) when the layer or layers on the web are sufficiently solidified to readily withstand such treatment without damage to the finish of the layer or layers.

All in all, the improved method and apparatus ensure that the solvent is expelled in a highly predictable manner, with savings in energy (when compared with heretofore known methods and apparatus), and in such a way that the surface finish of the layer or layers on the dried web 1 is superior to that which can be achieved in accordance with heretofore known methods and by resorting to heretofore known apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of expelling volatile constituents from an elongated substrate having a coating which contains volatile constituents and is to be dried as a result of expulsion of volatile constituents and from the coating, comprising the steps of moving the substrate in a first direction along a predetermined path having an inlet and an outlet; admitting a stream of inert gas into said path at said outlet and conveying the admitted stream along said path in a second direction counter to said first direction whereby the inert gas entrains volatile constituents from the coating; heating the inert gas to a predetermined maximum drying temperature prior to admission into said path; withdrawing the inert gas and the entrained volatile constituents from said path at said inlet; and conditioning the inert gas between said outlet and said inlet, including cooling the stream of inert gas in a plurality of successive stages to maintain the inert gas slightly below the condition of saturation with volatile constituents not later than at said inlet.

2. The method of claim 1, wherein each of said stages includes conveying inert gas along a second path from and back into said predetermined path and cooling the inert gas in the second path.

3. The method of claim 1, wherein each of said stages includes maintaining the temperature of inert gas at a constant value in a section of said path.

4. The method of claim 1, further comprising the step of measuring the concentration of entrained volatile constituents in the stream which is withdrawn from said path, said conditioning step including regulating the mass flow of inert gas in said path as a function of measured concentration to thus ensure that the inert gas is maintained slightly below said condition of saturation not later than at said inlet.

5. The method of claim 1, further comprising the step of regulating the speed of flow of said stream along said path.

6. The method of claim 5, wherein said regulating step includes reducing the speed of the stream during flow from said outlet toward said inlet.

7. The method of claim 1, wherein said conveying step includes advancing the stream of inert gas along an endless second path including a portion which coincides with said predetermined path.

8. Apparatus for expelling volatile constituents from the coating of an elongated substrate, comprising means for moving the substrate in a first direction along a single predetermined path having an inlet and an outlet; a source of inert gas; means for conveying a stream of inert gas from said source along a second path having a portion which coincides with said predetermined path and wherein the inert gas of said stream flows in a second direction counter to said first direction; means for heating said stream; and means for cooling the inert gas of said stream in said portion of said second path, said portion of said second path including a plurality of sections which are disposed in series along said single predetermined path and wherein said stream of inert gas flows from and back into said predetermined path and said cooling means including devices for cooling the stream of inert gas in said sections.

9. The apparatus of claim 8, further comprising means for regulating the rate of flow of inert gas in at least one of said sections.

10. The apparatus of claim 8, further comprising means for returning the stream of inert gas from said inlet back to said source.

11. The apparatus of claim 10, further comprising means for regulating the rate of flow of inert gas in said returning means.

12. The apparatus of claim 8, wherein said conveying means defines an endless second path for the stream of inert gas.

13. The apparatus of claim 8, wherein said predetermined path includes a plurality of sections including a first section at said inlet and a last section at said outlet, and further comprising means for heating said first section to a temperature slightly above the temperature of inert gas therein.

14. The apparatus of claim 8, wherein said conveying means includes a conduit connecting said source with said outlet and said heating means is operative to heat inert gas in said conduit.

* * * * *